US005529973A

United States Patent [19]

Shinohara et al.

[11] Patent Number: 5,529,973

[45] Date of Patent: Jun. 25, 1996

[54] THERMAL TRANSFER RECORDING SHEET

[75] Inventors: Hideo Shinohara; Tsutomu Taki; Katsuhiko Kuroda; Takashi Morishima, all of Yokohama, Japan

[73] Assignee: Mitsubishi Chemical Corporation, Japan

[21] Appl. No.: 240,104

[22] Filed: May 9, 1994

[30] Foreign Application Priority Data

| | | | |
|---|---|---|---|
| May 7, 1993 | [JP] | Japan | 5-106905 |
| May 14, 1993 | [JP] | Japan | 5-113131 |
| May 17, 1993 | [JP] | Japan | 5-114723 |
| Dec. 15, 1993 | [JP] | Japan | 5-315251 |

[51] Int. Cl.[6] ..... B41M 5/035; B41M 5/38

[52] U.S. Cl. ..... 503/227; 428/195; 428/323; 428/327; 428/328; 428/331; 428/412; 428/447; 428/480; 428/488.4; 428/500; 428/522; 428/913; 428/914

[58] Field of Search ..... 8/471; 428/195, 428/447, 484, 488.1, 488.4, 913, 914, 323, 327, 328, 331, 412, 480, 500, 522; 503/227

[56] References Cited

U.S. PATENT DOCUMENTS

| | | | |
|---|---|---|---|
| 4,892,860 | 1/1990 | Vanier | 503/227 |
| 4,902,669 | 2/1990 | Matsuda et al. | 503/227 |
| 5,143,782 | 9/1992 | Morishima et al. | 428/327 |
| 5,308,681 | 5/1994 | Taki et al. . | |

FOREIGN PATENT DOCUMENTS

| | | | |
|---|---|---|---|
| 55-7467 | 8/1980 | Japan | 428/488.4 |
| 55-146790 | 8/1980 | Japan | 428/488.4 |
| 56-155794 | 6/1981 | Japan | 428/488.4 |
| 57-74195 | 3/1982 | Japan | 428/488.4 |
| 57-129789 | 9/1982 | Japan | 428/488.4 |
| 4-135896 | 2/1992 | Japan | 428/488.4 |
| 4-197793 | 10/1992 | Japan | 428/488.4 |

*Primary Examiner*—B. Hamilton Hess
*Attorney, Agent, or Firm*—Nixon & Vanderhye

[57] ABSTRACT

The disclosure describes a thermal transfer recording sheet comprising a base film, a colorant layer provided on one side of said base film and containing a heat-transferable dye, and a heat-resistant lubricating layer provided on the other side of said base film and containing a thermoplastic resin having a glass transition point of not less than 50° C., an amino-modified silicone oil and a carboxy-modified silicone oil.

17 Claims, 1 Drawing Sheet

THERMAL TRANSFER RECORDING SHEET

BACKGROUND OF THE INVENTION

The present invention relates to a thermal transfer recording sheet. More particularly, it relates to a thermal transfer recording sheet which can be used advantageously for color recording by OA terminals such as printer, facsimile, copier, etc., and for color recording of television images.

Various systems such as electrophotography, ink jetting and thermal transfer recording have been proposed and studied for the color recording, and thermal transfer recording is advantageous as compared with other systems in many respects such as maintenance of the apparatus, easiness of operation and inexpensiveness of expendables.

In the thermal transfer recording system, an image receiving material is placed on the ink-applied surface of a thermal transfer recording sheet applied with an ink containing colorants, and the backside of the said thermal transfer recording sheet is heated by a thermal printing head to transfer colorants to an image receiving material. The thermal transfer recording methods can be classified into two types, for instance, a thermofusion-type transfer recording system using a heat-fusible ink and a sublimation-type transfer recording system using an ink containing sublimable dyes.

In these types of thermal transfer recording system, however, the thermal transfer recording sheet is heated to a high temperature by the thermal head, so that if the base film of the thermal transfer recording sheet is not sufficiently high in heat resistance, the base film may be fused to the thermal head to cause improper running of the head relative to the thermal transfer recording sheet and other undesirable phenomena such as sticking, wrinkling or break of the thermal transfer recording sheet, making it unable to perform proper recording. For the improvement of heat resistance of the base film, it has been proposed to provide a protective film composed of various kinds of heat-resistant resin on the opposite surface of the base film to the colorant layer (Japanese Patent Application Laid-Open (KOKAI) Nos. 55-7467 and 57-74195). Also, for improving the running property of the sheet, it has been proposed to incorporate heat-resistant fine particles, lubricant, surfactant or the like substance in the protective layer (Japanese Patent Application Laid-Open (KOKAI) Nos. 55-146790, 56-155794 and 57-129789).

Recently, however, new problems have arisen in recording according to the said system. Because of accelerating of recording speed, a higher energy than used hitherto is given to the thermal head, resulting in a large load to the thermal transfer sheet, and it is difficult in the methods proposed in the above-mentioned Japanese KOKAIs to obtain a satisfactory running property of the thermal head relative to the thermal transfer recording sheet. Especially, in the case of thermal transfer recording sheet for the sublimation-type thermal transfer recording system using sublimable dyes, there is required a higher energy for recording than the case of thermal transfer recording sheet for thermofusion-type thermal transfer recording system using a heat-fusible ink, so that it is impossible to obtain the satisfactory running property of the thermal head relative to the thermal transfer recording sheet even if using a thermal transfer recording sheet treated with the proposed methods.

In running of thermal transfer recording sheet, it is ideal that the coefficient of friction between the backside of the thermal transfer recording sheet and the thermal head be kept constant irrespective of whether heating is applied or not, or the degree of heating. Since there are high-density portions and low-density portions in every image, the energy applied to the thermal head varies from part to part. If it is supposed that the coefficient of friction varies greatly depending on the degree of heating, then the tension exerted to the sheet varies from part to part in each image, that is, the sheet is pulled under high tension at a certain part, while almost no tension is exerted at another part. Under such a situation, running of the sheet and/or the image receiving material superposed therewith may deviate in the lateral direction, or the image receiving material may be traveled aslant, making it hard to obtain a clear and vivid image. Regarding coefficient of friction, there are known coefficient of static friction and coefficient of kinetic friction, and it is known that usually coefficient of static friction is greater than coefficient of kinetic friction. It is especially notable that coefficient of static friction during thermal printing is increased due to softening of the heat-resistant lubricating layer by heat, thereby encouraging occurrence of the sticking phenomenon such as mentioned above. The heat-resistant lubricating layer which the difference of coefficient of friction between heat-supplying state or no heat-supplying state is minimized is desirable. Further, a thermal transfer recording sheet which shows low in coefficient of static friction at heat-supplying state is required.

As the material of the practical heat-resistant lubricating layer having the desired running property, a crosslinked resin is prevalently used for the purpose of enhancing heat resistance. Specifically, UV-curing or heat-curing crosslinked resins have been proposed and practically used.

However, any of these crosslinked-type heat-resistant lubricating layers is rigid in its coating film, so that its touch with the thermal head is not uniform, causing nonuniform heat-conduction and roughening of the image formed.

Further, for producing these heat-resistant lubricating layers, since crosslinking treatment is essential, there are the serious problems relating to productivity. For instance, there is required a long-time heat-curing step or a specific UV-curing apparatus, and also difficulties are encountered in elevating the throughput rate.

Japanese Patent Application Laid-Open (KOKAI) No. 2-8087 proposes to incorporate an aminoalkyl-terminated polysiloxane and organic particles as lubricating material in the heat-resistant lubricating layer for enhancing the running property of the thermal head relative to the thermal transfer recording sheet, but this proposal was still unsatisfactory for realizing a practically satisfactory running property and storage stability.

These problems can be solved by using of a thermoplastic resin as the heat-resistant lubricating layer, but even in this case, there may arise the problem that the undesirable phenomena such as sticking tend to take place with the conventional synchronous transfer system.

As the result of the present inventors' earnest studies for overcoming the above-mentioned problems, it has been found that by conducting a thermal transfer recording using a thermal transfer recording sheet having a heat-resistant lubricating layer containing three specific components, while properly adjusting the relationship between the timing of feeding the thermal transfer recording sheet having the said heat-resistant lubricating layer and the timing of heat-supplying the thermal head, that is, by conducting a thermal transfer recording using a thermal transfer recording sheet having a heat-resistant lubricating layer containing a thermoplastic resin with a glass transition temperature of not less than 50° C., an amino-modified silicone oil and a carboxy-modified silicone oil, especially conducting such transfer recording according to a thermal transfer recording system in which the feeding of thermal transfer recording sheet and heat-supplying of the thermal head are synchronized with each other, the thermal transfer recording sheet is not fused to the thermal head and the thermal head can maintain a good running property relative to the thermal transfer recording sheet even during high energy recording, making it possible to carry out efficient and uniform transfer recording, and to obtain a high-quality image free of roughness. The present invention has been attained on the basis of these findings.

SUMMARY OF THE INVENTION

An object of the present invention is to provide a thermal transfer recording sheet which does not suffer sticking with the thermal head during recording, has good traveling (running) property and storage property and is produced through a simplified production process and very high in productivity.

Another object of the present invention is to provide a thermal transfer recording sheet which is small in coefficient of friction and also minimized in difference of coefficient of friction during heat-supplying and that during no heat-supplying to the sheet.

Still another object of the present invention is to provide a thermal transfer recording method which causes no sticking phenomenon of the recording sheet with the thermal head during recording, enables smooth running of the recording sheet, is capable recording a high-quality image free of roughness and is also high in productivity.

To accomplish the aims, in a first aspect of the present invention, there is provided a thermal transfer recording sheet comprising a base film, a colorant layer containing a heat-transferable dye and provided on one side of the base film, and a heat-resistant lubricating layer provided on the other side of the said base film, wherein the said heat-resistant lubricating layer contains a thermoplastic resin having a glass transition temperature of not lower than 50° C., an amino-modified silicone oil and a carboxy-modified silicone oil.

In a second aspect of the present invention, there is provided a thermal transfer recording sheet comprising a base film, a colorant layer provided on one side of said base film and containing a heat-transferable dye, and a heat-resistant lubricating layer provided on the other side of said base film and containing a thermoplastic resin having a glass transition point of not less than 50° C., an amino-modified silicone oil; a carboxy-modified silicone oil; and spherical particles and fine particles having a smaller average particle size than the spherical particles; and/or a high-molecular weight compound having as its component an acrylic ester, a methacrylic ester or both of acrylic and methacrylic esters of an alkyl alcohol having 6 to 10 carbon atoms in the molecule.

In a third aspect of the present invention, there is provided a thermal transfer recording method comprising heat-supplying to a thermal transfer recording sheet comprising a base film, a colorant layer provided on one side of said base film and containing a heat-transferable dye, and a heat-resistant lubricating layer provided on the other side of said base film through a thermal head to transfer the heat-transferable dye in said sheet to an image receiving material from said heat-resistant lubricating layer side of said base film, characterized in that said heat-resistant lubricating layer containing a thermoplastic resin having a glass transition point of not less than 50° C. and the feeding of the thermal transfer receiving sheet and heat-supplying through said thermal head are conducted simultaneously each other.

DETAILED DESCRIPTION OF THE INVENTION

Figure 1A:
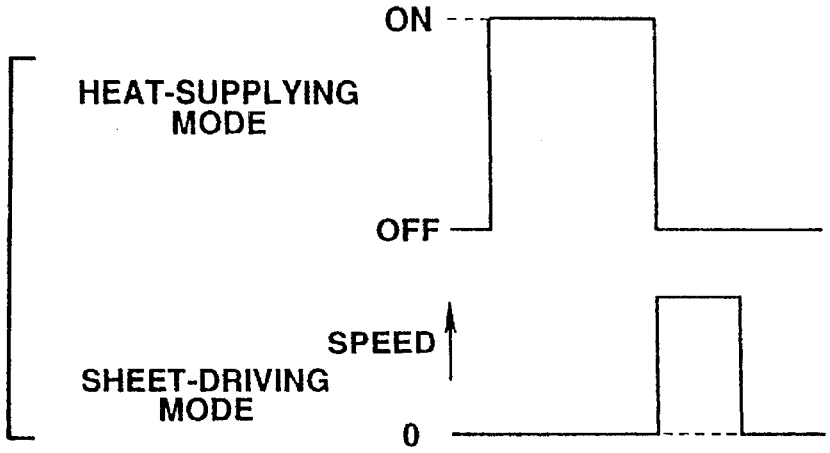
FIG. 1A is a diagrammatic illustration of the relationship in a conventional and synchronized system between heat supplied through the thermal head in the heat-supplying mode and driving the thermal transfer sheet.

The thermoplastic resin (binder resin) used in the heat-resistant lubricating layer of the present invention can be properly selected from the ordinary thermoplastic resins having a glass transition temperature of not less than 50° C. For example, acrylic resins, vinyl chloride copolymers, styrene/acrylonitrile copolymers, polycarbonates, polyesters, polyvinyl butyral, polyacetals and the like may be exemplified.

If the glass transition temperature of the thermoplastic resin (binder resin) is too low, there may take place transfer of dye from the rolled-up colorant layer side or blocking between the colorant layer and the heat-resistant lubricating layer when the thermal transfer recording sheet is kept in storage at a relatively high temperature. A thermoplastic resin with a glass transition temperature of not lower than 50° C. is preferable in terms of storability of the color sheet.

Preferred examples of the modified silicone oils usable in the present invention are those represented by the following formula (1):

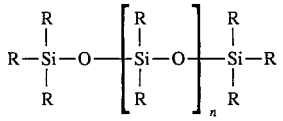

(1)

In the unmodified silicone oils, R in the above-mentioned formula (1) represents methyl and/or phenyl group. In the case of amino-modified silicone oils, at least part of R in the above-mentioned formula (1) are amino group, and in the case of carboxy-modified silicone oils, at least part of R in the above-mentioned formula (1) are carboxyl group.

The modified silicone oils can be synthesized according to a conventional method, for example, the method described in "Silicone Handbook" (compiled by K. Ito, published by Nikkan Kogyo Shimbun, p.163). As a main raw material, octamethylcyclotetrasiloxane tetramethyltetraphenylcyclotetrasiloxane or octaphenylcyclotetrasiloxane is preferably used. This raw material is reacted with a silicone compound having a modifying group (amino group or carboxyl group) to synthesize a desired silicone oil.

The modification amount of the modified silicone oil used in the present invention is preferably not more than 5,000 g (calculated as weight of the oil containing a modifying group) based on one mole of the modifying group. The viscosity of the modified silicone oil is preferably in the range of 20 to 7,000 cst.

The amino-modified silicone compound used in the present invention is one whose amine equivalent (gram number of the oil containing one mole of amino group) is usually not more than 5,000, preferably 500 to 3,000, and its viscosity (at 25° C.) is usually in the range of 20 to 4,000 cst, preferably 50 to 2,000 cst. The carboxy-modified silicone compound used in the present invention is one whose carboxyl equivalent (gram number of the oil containing one mole of carboxyl group) is usually not more than 4,000, preferably 600 to 3,000, and its viscosity (at 25° C.) is usually in the range of 50 to 7,000 cst, preferably 100 to 6,000 cst.

For forming a heat-resistant lubricating layer in the present invention, the amino-modified silicone oil and carboxy-modified silicone oil are mixed with the binder resin. As for their mixing ratio, they are mixed so that the blending weight of amino-modified silicone oil and carboxy-modified silicone oil is 1 to 20 wt %, preferably 5 to 15 wt % based on the binder resin. The weight ratio of the amino-modified silicone oil to carboxy-modified silicone oil is preferably 100:1 to 1:100, more preferably 10:1 to 1:10.

In the present invention, it is recommended to additionally incorporate spherical particles and fine particles having a smaller average particle size than the spherical particles in the heat-resistant lubricating layer for improving of the running property of the sheet and head cleanability.

As the spherical particles, there can be used in the present invention various kinds of organic and inorganic heat-resistant particles. Especially, spherical particles of silicone resins and spherical particles of silicone elastomers are preferred. The average particle size is preferably in the range of 0.5 to 5 μm.

As for the fine particles used together with the spherical particles, there can be used various kinds of organic and inorganic heat-resistant particles, and their shape is not specified. Finely divided silica particles, finely divided titanium oxide particles and the like are especially suitable as their thermal head cleaning-effect is excellent. Their average particle size should be at least smaller than that of the spherical particles and also less than the thickness of the heat-resistant lubricating layer. It is preferably not more than 1/10 of the average particle size of the spherical particles, more preferably 0.01 to 0.1 μm.

As regards the blending ratio of these particles, the spherical particles are used in an amount of preferably 1 to 50 parts by weight, more preferably 5 to 20 parts by weight based on 100 parts by weight of binder resin, while the fine particles are used in an amount of preferably 5 to 100 parts by weight, more preferably 10 to 50 parts by weight based on 100 parts by weight of binder resin. As for the surface configuration of the heat-resistant lubricating layer it is preferable to form the lubricating layer, so that its surface have a configuration where the spherical particles project from the surface connecting the fine particles in the surface of the layer.

In the present invention, it is more preferable to incorporate in the heat-resistant lubricating layer as a thermoplastic resin a high-molecular weight compound containing as its component an acrylic acid ester and/or a methacrylic acid ester of an alkyl alcohol having a carbon number of 6 to 10.

The acrylic acid ester and methacrylic acid ester of alkyl alcohol having a carbon number of 6 to 10, which constitutes a component of the high-molecular weight compound used in the present invention, is not specified. But, there can be used, for instance, esters of alcohols such as hexanol, heptanol, octanol, decanol, dimethylbutanol, ethylbutanol, methylpentanol, dimethylpentanol, ethylpentanol, methylhexanol, ethylhexanol, methylheptanol, cyclohexylethanol, dimethylheptanol, ethyldimethylpentanol, trimethylhexanol, cyclohexylpropanol, dimethyloctanol, cyclohexanol, etc., and acrylic or ethacrylic acids.

The high-molecular weight compound containing the esters as a component are a polymer comprising at least one of the acrylic and methacrylic acids or a copolymer of at least one of the acrylic or methacrylic acids and another suitable material. The "another suitable material" is a material used for adjusting the properties of the polymers and is not specified in the present invention. But, there can be used, for example, acrylic or methacrylic acid ester having a carbon number of not more than 5, such as methyl methacrylate, methyl acrylate, ethyl acrylate, ethyl methacrylate, propyl acrylate, propyl methacrylate, isopropyl acrylate, isopropyl methylacrylate, butyl acrylate and butyl methacrylate; and vinyl-based compounds such as styrene, α-methylstyrene, vinyltoluene, acrylic acid, methacrylic acid, maleic acid, acrylonitrile, methacrylonitrile, acrylamide, and ethylene chloride. Of these materials, methyl methacrylate and butyl methacrylate are preferably used.

For obtaining a high-molecular weight compound, the component materials mixed in a prescribed ratio are subjected to radical polymerization in a solution according to a conventional method.

The content of the acrylic or methacrylic acid ester of an alkyl alcohol having a carbon number of 6 to 10 in the constituting composition of the high-molecular weight compound used in the present invention is usually 0.5 to 100 mol %, preferably 1 to 20 mol %.

The mixing ratio (A:B) of the high-molecular weight compound (A) containing an acrylic or methacrylic acid ester of an alcohol having a carbon number of 6–10 to the binder resin (B) is preferably 1:0–100, more preferably 1:0.05–50 (by weight). The mixing ratio [(A+B):(C+D)] of the high-molecular weight compound (A) and binder resin (B) to the amino-modified silicone compound (C) and carboxy-modified silicone compound (D) is generally 1:0.02–0.3, preferably 1:0.05–0.2 (by weight).

The content of the acrylic or methacrylic acid ester of an alcohol having a carbon number of 6–10 in the constituting composition of the whole high-molecular weight material is preferably from not less than 1 wt % to not more than 100 wt %, more preferably not less than 2 wt %.

The heat-resistant lubricating layer of the transfer sheet of the present invention can be produced by mixing a thermoplastic resin having a glass transition temperature of not lower than 50° C., an amino-modified silicone oil and a carboxy-modified silicone oil as essential components plus, if necessary, spherical particles and fine particles and/or a high-molecular weight compound containing an acrylic acid ester and/or a methacrylic acid ester of an alkyl alcohol having a carbon number of 6–10, adding a solvent to prepare a coating solution for forming the heat-resistant lubricating layer, applying the obtained coating solution on a base film and drying the same.

As the solvents which is suitably used for forming the coating solution, aromatic hydrocarbon-based solvents such as toluene and xylene; ketone-based solvents such as methyl ethyl ketone, methyl isobutyl ketone and cyclohexanone; ester-based solvents such as ethyl acetate and butyl acetate; alcohol-based solvents such as isopropyl alcohol, butanol and methyl cellosolve; halogen-based solvents such as methylene chloride, trichloroethylene and chlorobenzene; ether-based solvents such as dioxane and tetrahydrofuran; and amide-based solvents such as dimethylformamide and N-methylpyrrolidone may be exemplified.

As for the method of applying the coating solution for forming the heat-resistant lubricating layer, the coating solution may be applied by a suitable known method such as gravaure coater, reverse coater, air doctor coater, etc., (described in Y. Harasaki, Coating System (1979) Maki Shoten Co., Ltd).

The thickness of the heat-resistant lubricating layer formed on the base film is usually 0.1 to 10 μm, preferably 0.3 to 5 μm.

As the base film of the thermal transfer recording sheet according to the present invention, there can be used, for example, polyethylene terephthalate film, polyamide film, polyaramide film, polyimide film, polycarbonate film, polyphenylene sulfide film, polysulfone film, cellophane, triacetate film, polypropylene film and the like. Of these films, polyethylene terephthalate film is preferred in view of mechanical strength, dimensional stability, heat resistance and cost. Biaxially stretched polyethylene terephthalate film is especially preferred. The thickness of the base film is 1 to 30 μm, preferably 2 to 10 μm.

An adhesive layer may be formed on the base film for the purpose of improving adhesiveness to the heat-resistant lubricating layer. The composition of the adhesive layer is not specified, but usually polyesters is preferably used.

The method for forming a colorant layer provided on the surface opposite of the base film to the heat-resistant lubricating layer of the thermal transfer recording sheet is also not specified in present invention. For instance, in the case of a sublimation-type thermal transfer recording sheet, a subliming or heat-diffusing pigment and a binder resin with high heat resistance are dissolved or dispersed in a suitable solvent to prepare an ink, and the prepared ink is applied on the base film and dried. In the case of a fusion-type thermal transfer recording sheet, a colorant such as a pigment is dissolved or dispersed in a heat-fusible material, if necessary by using a solvent, to prepare an ink, and the prepared ink is applied on the base film and dried.

As the subliming or heat-diffusing dye used for the sublimation-type thermal transfer recording sheet, nonionic dyes such as azo dyes, anthraqinone dyes, nitro dyes, styryl dyes, naphthoquinone dyes, quinophthalone dyes, azomethine dyes, cumarin dyes and condensed polycyclic dyes can be used. As the binder resin, there can be used polycarbonates, polysulfones, polyvinyl butyral, phenoxy-based resins, polyarylates, polyamides, polyaramides, polyimides, polyether-imides, polyesters, acrylonitrile-styrene-based resins, vinyl-based resins and cellulose-based resins such as acetyl cellulose, methyl cellulose and ethyl cellulose. As solvent, there can be used aromatic hydrocarbon-based solvents such as toluene and xylene; ketone-based solvents such as methyl ethyl ketone, methyl isobutyl ketone and cyclohexanone; ester-based solvents such as ethyl acetate and butyl acetate; alcohol-based solvents such as isopropanol, butanol methyl cellosolve; ether-based solvents such as dioxane and tetrahydrofuran; and amide-based solvents such as dimethylformamide and N-methylpyrrolidone.

The colorants usable for the thermalfusion-type transfer recording sheet include inorganic pigments such as carbon black and organic pigments such as azo pigments and condensed polycyclic pigments. The dyestuffs usable for the thermal transfer recording sheet include acidic dyes, basic dyes, oil-soluble dyes and metal complex salt dyes. As the heat-fusible material, a solid or semisolid material having a melting point of 40°–120° C. is preferably used. For example, waxes such as paraffin wax, microcrystalline wax, carmaiba wax, montan wax, Japan wax and fat, and oil type synthetic waxes and thermoplastic resins such as ethylene-vinylacetate copolymer and polyamides may be exemplified. As the solvent, the same solvent as used in the case of sublimation-type thermal transfer recording sheet described above can be employed.

The ink used for the colorant layer may contain, besides the above-described components, the additives such as organic or inorganic non-subliming particles, dispersant, antistatic agent, anti-blocking agent, defoaming agent, anti-oxidant, viscosity modifier, etc.

This ink can be applied in the similar way as in the case of formation of the heat-resistant lubricating layer described above, and the thickness of the colorant layer after dried is preferably 0.1 to 5 μm, In the production of the thermal transfer recording sheet according to the present invention, in order to improve adhesiveness to the base film of the respective layers formed by the said coating treatment, the surface of the base film may be subjected to a corona discharge treatment or under-coating treatment with a suitable resin such as polyesters, cellulose-based resins, polyvinyl alcohols, urethane-based resins, polyvinylidene chlorides or the like.

In the thermal transfer recording according to the present invention, the driving of the thermal transfer recording sheet and heat-supplying to the transfer sheet by the thermal head are conducted at the same time. In the conventional practice, the driving of the thermal transfer recording sheet was not conducted during heat-supplying to the recording sheet, and the heat-supplying to the recording sheet was not conducted during the sheet-driving. In the present invention, timing of the driving of the thermal transfer recording sheet and timing of heat-supplying to the said sheet are perfectly independent of each other, which means that the sheet-driving is performed even during heat-supplying to the thermal transfer recording sheet.

In the present invention, however, it is not essential that the thermal transfer sheet should be fed successively throughout the period of heat-supplying. It is envisaged in the present invention to have the sheet fed during a substantial period of time in which sticking phenomenon is not allowed to take place, usually during a half or more, preferably not less than 60%, more preferably not less than 70% based on the period of heat-supplying.

Figure 1B:
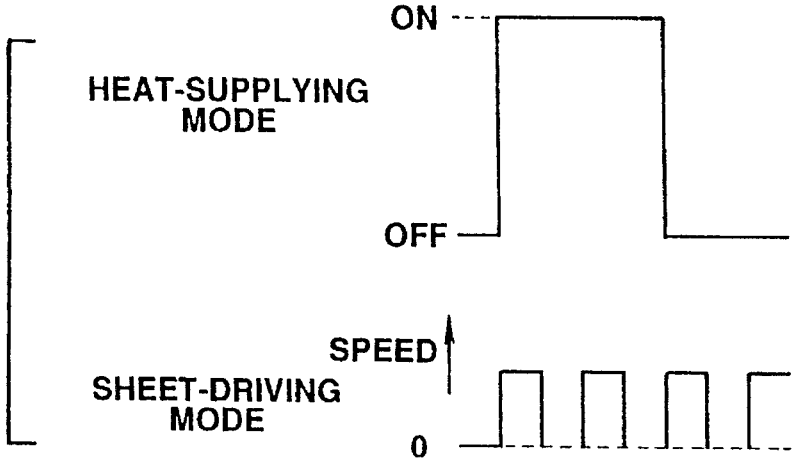
FIG. 1B is a diagrammatic illustration of the relationship according to the present invention between heat supplied in the heat-supplying mode and movement of the thermal transfer sheet.
Figure 1C:
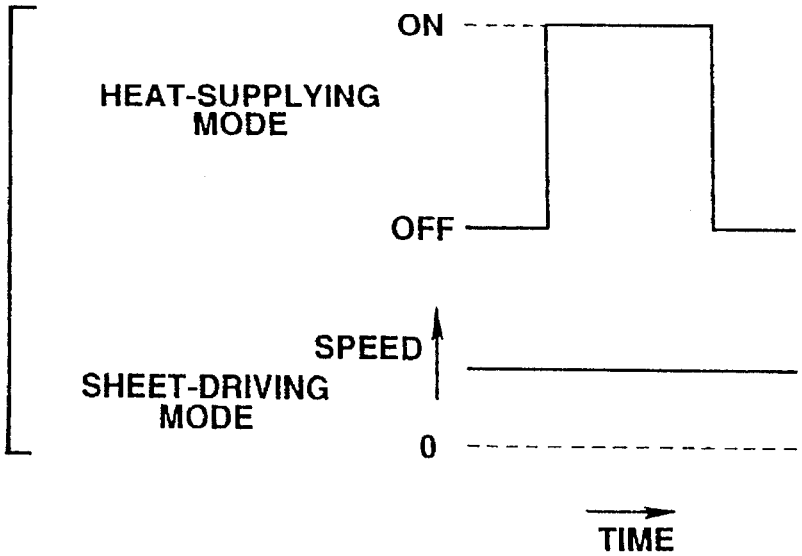
FIG. 1C is a diagrammatic illustration according to the present invention of the relationship between heat supplied through the thermal head in the sheet-driving mode and movement of the thermal transfer sheet.

Timing of sheet-driving and heat-supplying in a conventional synchronized system is illustrated in FIG. 1 (*a*), and that in the system of the present invention is illustrated in FIG. 1 (*b*) and (*c*).

The thermal transfer recording sheet of the present invention is not fused to the thermal head even during high-energy recording and has a good running property. It also has good thermal head cleanability, so that the thermal bead can be kept clean and high-efficient transfer recording can be performed.

It is also possible to obtain a high-quality transfer recording even after storage. Further, for production of heat-resistant lubricating layer, since the desired effect can be derived from coating treatment alone, no curing treatment is required. Hence, the production process is simplified, and the objective thermal transfer recording sheet can be obtained with very high productivity.

Moreover, the thermal transfer recording sheet having a heat-resistant lubricating layer according to the present invention is small in coefficient of friction both during heat-supplying and during no heat-supplying is conducted. This sheet is also small in difference between friction coefficient during heat-supplying and during no heat-supplying is conducted, and therefore has excellent running property.

According to the thermal transfer recording method of the present invention, a specific timing system is set for the feeding (driving) of the thermal transfer recording sheet and the heat-supplying thereto, and this system combined with the presence of a specific heat-resistant lubricating layer can realize good running property of the sheet and recording of high-quality image without sense of roughness. Also, the thermal transfer recording system of the present invention is very high efficiency in productivity and is low produced with cost.

EXAMPLES

The present invention is further illustrated below with reference to the examples and comparative examples, but these examples are merely intended to be illustrative and not to be construed as limiting the scope of the invention.

Examples 1–4

(a) Production of thermal transfer recording sheet

A biaxially stretched polyethylene terephthalate film (5 μm in thickness) was used as base film. A coating solution having the composition shown in Table 1 was coated on one side of the base film to a wet coating thickness of about 10 μm and then the obtained coating film was dried at a temperature of 100° C. for one minute to form a heat-resistant lubricating layer.

On the opposite surface of the base film to the heat-resistant lubricating layer was applied an ink composed of 5 parts of a subliming dye (C. I. Solvent Blue 95), 10 parts of polysulfone and 85 parts of chlorobenzene, and the ink coat was dried to form a colorant layer having about 1 μm in thickness, thereby producing a thermal transfer recording sheet.

(b) Manufacture of image receiving material

A solution composed of 10 parts of a saturated polyester (trade name "TR-220"), 0.5 parts of an amino-modified silicone ("KF-393"), 15 parts of methyl ethyl ketone and 15 parts of xylene was coated on a synthetic paper (Yupo FPG150" produced by Oji Yuka Synthetic Paper Co., Ltd) by a wire bar, and the coating film was dried (dry coating thickness: about 5 μm) and then heat-treated in an oven at a temperature of 100° C. for 30 minutes to make an image receptor.

(c) Result of transfer recording

The resin-applied side of the image receiving material was placed on the colorant layer of the thermal transfer recording sheet produced in the manner described above, and transfer recording was carried out (8 line/mm density, 200 cm, continuous (nonperiodical) sheet-feeding) on the heat-resistant lubricating layer side of the said recording sheet with a thermal head having a heat-generating resistor density of 8 dot/mm by applying a power of 0.4 W/dot for 10 milliseconds in the recording period of 33 milliseconds. The results are shown as recording characteristics (running property) in Table 3. In each case, there took place no fusion of the sheet to the head, and no stick sound was generated. Also, the sheet ran smoothly and high-efficient transfer recording could be performed.

For determining storage stability of the recording sheet, transfer of the dye from the colorant layer side (back-side transfer) was checked after keeping the sheet under the conditions of 40° C. and 80% RH for two weeks. As seen from the results shown in Table 3, each sheet according to the present invention suffered almost no back-side transfer of dye and showed excellent storage stability.

Comparative Examples 1–4

Various types of thermal transfer recording sheets were produced by following the same procedure as Examples 1–4 described above except for the use of the coating solutions specified in Table 2, and transfer recording was carried out by using these sheets in the same way as described above. The results are shown in Table 3. In each case, there took place sticking (nonuniform feeding) due to fusion of the sheet to the thermal head, and no satisfactory storage stability could be obtained. Also, there occurred heavy back-side transfer of dye from the colorant layer and a decrease of recorded image density. Thus the sheets were incapable of practical use.

TABLE 1

| No. | 1-a Components | (parts) | 1-b Components | (parts) | 1-c Components | (parts) |
|---|---|---|---|---|---|---|
| Resin | Acrylic resin (Tg = 95° C.) Dianal BR-108 (Mitsubishi Rayon) | 8.25 | Acrylic resin (Tg = 95° C.) Dianal BR-108 (Mitsubishi Rayon) | 8.25 | Vinyl chloride/Vinyl acetate copolymer VAGH (Tg = 79° C.) (UCC) | 8.25 |
| Lubricant | Amino-modified silicone *a KF-857 (Shin-Etsu Chemical) | 0.6 | Amino-modified silicone *b KF-393 (Shin-Etsu Chemical) | 0.6 | Amino-modified silicone *a KF-857 (Shin-Etsu Chemical) | 0.6 |
| | Carboxy-modified silicone *c X-22-162C (Shin-Etsu Chemical) | 0.6 | Carboxy-modified silicone *d BY16-750 (Toray Silicone) | 0.6 | Carboxy-modified silicone *c X-22-162C (Shin-Etsu Chemical) | 0.6 |
| Fine Particles | Trefil R-930 (Toray Silicone) | 0.25 | Trefil DY-33-604 (Toray Silicone) | 0.25 | Aerozil silica R-812 (nippon Aerosil) | 0.25 |

TABLE 1-continued

| | | | | | | |
|---|---|---|---|---|---|---|
| Solvent | Toluene | 60 | Toluene | 60 | Toluene | 60 |
| | Methyl ethyl ketone | 30 | Methyl ethyl ketone | 30 | Methyl ethyl ketone | 30 |

(Note):

| | Amount modified | Viscosity (250° C.) |
|---|---|---|
| *a | 830 | 70 cst |
| *b | 360 | 60 cst |
| *c | 2330 | 207 cst |
| *d | 720 | 166 cst |

Tg = glass transition temperature

TABLE 2

| No. | 2-a Components | (parts) | 2-b Components | (parts) | No. | 2-a Components | (parts) |
|---|---|---|---|---|---|---|---|
| Resin | Acrylic resin (Tg = 95° C.) Dianal BR-108 (Mitsubishi Rayon) | 8.25 | Acrylic resin (Tg = 95° C.) Dianal BR-108 (Mitsubishi Rayon) | 8.25 | Resin | Vinyl chloride/ Vinyl acetate copolymer VAGH (Tg = 79° C.) (UCC) | 8.25 |
| Lubricant | Amino-modified silicone FK-857 (Shin-Etsu Chemical) | 1.2 | Carboxy-modified silicone X-22-162C (Shin-Etsu Chemical) | 1.2 | Lubricant | Amino-modified silicone KF-857 (Shin-Etsu Chemical) | 1.2 |
| Fine Particles | Aerozil silica R-812 (Nippon Aerosil) | 0.25 | Aerozil silica R-812 (Nippon Aerosil) | 0.25 | Particle | Aerozil silica R-812 (Nippon Aerosil) | 0.25 |
| Solvent | Toluene | 60 | Toluene | 60 | Solvent | Toluene | 60 |
| | Methyl ethyl ketone | 30 | Methyl ethyl ketone | 30 | | Methyl ethyl ketone | 30 |

TABLE 3

| No. | Solution composition | Coating weight (g/m$^2$) | Recording characteristics (running property) | Storage stability |
|---|---|---|---|---|
| Example 1 | 1-a | 1.5 | Good | Good |
| Example 2 | 1-a | 2.5 | Good | Good |
| Example 3 | 1-b | 1.5 | Good | Good |
| Example 4 | 1-c | 1.5 | Good | Good |
| Comp. Example 1 | 2-a | 1.5 | Nonuniform feeding | back-side transfer |
| Comp. Example 2 | 2-a | 2.5 | Nonuniform feeding | back-side transfer |
| Comp. Example 3 | 2-b | 1.5 | Nonuniform feeding | back-side transfer |
| Comp. Example 4 | 2-c | 1.5 | Nonuniform feeding | back-side transfer Winkled |

Examples 5–8

(a) Production of thermal transfer recording sheet

A biaxially stretched polyethylene terephthalate film (5 μm in thickness) was used as base film. A coating solution having the composition shown in Table 4 was applied on one side of the said base film to a wet coating thickness of about 10 μm, and the obtained coating film was dried at a temperature of 100° C. for one minute to form a heat-resistant lubricating layer.

On the opposite surface of the base film to the heat-resistant lubricating layer was applied an ink composed of 5 parts of a subliming dye (C.I Solvent Blue 95), 10 parts of polysulfone and 85 parts of chlorobenzene, and the obtained ink coating film was dried to form a colorant layer having about 1 μm in thickness, thereby making a thermal transfer recording sheet.

(b) Manufacture of image receiving material

A solution composed of 10 parts of a saturated polyester (trade name "TR-220"), 0.5 parts of an amino-modified silicone ("KF393"), 15 parts of methyl ethyl ketone and 15 parts of xylene was applied on a synthetic paper (Yupo FPG150") by a wire bar, then dried (a dry coating thickness of about 5 μm) and heat-treated in an oven at a temperature of 100° C. for 30 minutes to make an image receptor.

(c) Result of thermal recording

The resin-applied side of the thus, obtained image receiving material was placed on the colorant layer of the thermal transfer recording sheet produced in the manner described above, and transfer recording was carried out (8 line/mm, 200 cm, continuous sheet-feeding (nonsynchronous, that is, sheet is fed even during heat application)) on the heat-resistant lubricating layer side of the recording sheet with a thermal head having a heat-generating resistor density of 8 dot/mm by applying a power of 0.4 W/dot for 10 milliseconds in one recording period of 33 milliseconds. The results are shown in Table 6. No fusion of the sheet to the thermal head took place, no stick sound was generated, the sheet ran smoothly, and consequently good transfer recording could be performed. Also, no deposit was seen on the head surface after recording, indicating excellent head cleanability of the sheet.

Comparative Examples 5–8

Various types of thermal transfer recording sheet were produced by following the same procedure as Examples 5–8 described above except for use of the coating solutions specified in Table 5. The results are shown in Table 6. There occurred sticking (nonuniform feeding) due to fusion of the sheet to the head, or no satisfactory cleanability was obtained, and deposit was seen on the head surface after recording. Thus, the sheets were incapable of practical use.

TABLE 4

| No. | 1-a' Components | (parts) | 1-b' Components | (parts) | 1-c' Components | (parts) |
|---|---|---|---|---|---|---|
| Resin | Acrylic resin (Tg = 95° C.) Dianal BR-108 (Mitsubishi Rayon) | 8.25 | Acrylic resin Dianal BR-108 (Mitsubishi Rayon) | 8.25 | Acrylic resin Dianal BR-108 (Mitsubishi Rayon) | 8.25 |
| Lubricant | Amino-modified silicone KF-857 (Shin-Etsu Chemical) | 0.6 | Amino-modified silicone KF-857 (Shin-Etsu Chemical) | 0.6 | Amino-modified silicone KF-857 (Shin-Etsu Chemical) | 0.6 |
| | Carboxy-modified silicone X-22-162C (Shin-Etsu Chemical) | 0.6 | Carboxy-modified silicone X-22-162C (Shin-Etsu Chemical) | 0.6 | Carboxy-modified silicone X-22-162C (Shin-Etsu Chemical) | 0.6 |
| Fine Particles | Aerozil silica R-812 Size: 0.01–0.02 μm (Nippon Aerosil) | 0.25 | Aerosil silica R-812 (Nippon Aerosil) | 0.25 | Aerozil silica R-812 (Nippon Aerosil) | 0.25 |
| | Trefil R-930 (Toray Silicone) Size: 0.7–1.4 μm | 0.25 | Trefil E-730S (Toray Silicone) Size: 1–2 μm | 0.25 | Benzoguanamine resin Eposter M (Nippon Shokubai) Size: 1–2 μm | 0.25 |
| Solvent | Toluene | 60 | Toluene | 60 | Toluene | 60 |
| | Methyl ethyl ketone | 30 | Methyl ethyl ketone | 30 | Methyl ethyl ketone | 30 |

TABLE 5

| No. | 2-a' Components | (parts) | 2-b' Components | (parts) | 2-c' Components | (parts) |
|---|---|---|---|---|---|---|
| Resin | Acrylic resin Dianal BR-108 (Mitsubishi Rayon) | 8.25 | Acrylic resin Dianal BR-108 (Mitsubishi Rayon) | 8.25 | Acrylic resin Dianal BR-108 (Mitsubishi Rayon) | 8.25 |
| Lubricant | Amino-modified silicone KF-857 (Shin-Etsu Chemical) | 0.6 | Amino-modified silicone KF-857 (Shin-Etsu Chemical) | 0.6 | Amino-modified silicone KF-857 (Shin-Etsu Chemical) | 0.6 |
| | Carboxy-modified silicone X-22-162C (Shin-Etsu Chemical) | 0.6 | Carboxy-modified silicone X-22-162C (Shin-Etsu Chemical) | 0.6 | Carboxy-modified silicone X-22-162C (Shin-Etsu Chemical) | 0.6 |
| Fine Particles | Aerozil silica R-812 (Nippon Aerosil) | 0.25 | Trefil R-930 (Toray Silicone) | 0.25 | Benzoguanamine resin Eposter M (Nippon Shokubai) Size: 1–2 μm | 0.25 |
| Solvent | Toluene | 60 | Toluene | 60 | Toluene | 60 |
| | Methyl ethyl ketone | 30 | Methyl ethyl ketone | 30 | Methyl ethyl ketone | 30 |

TABLE 6

| No. | Liquid composition | Coating weight ($g/m^2$) | Recording charcteristics: Running property | Recording charcteristics: Clean-ability |
|---|---|---|---|---|
| Example 5 | 1-a' | 1.5 | Good | Good |
| Example 6 | 1-a' | 2.5 | Good | Good |
| Example 7 | 1-b' | 1.5 | Good | Good |
| Example 8 | 1-c' | 1.5 | Good | Good |
| Comp. Example 5 | 2-a' | 1.5 | Bad | Good |
| Comp. Example 6 | 2-a' | 2.5 | Bad | Good |
| Comp. Example 7 | 2-b' | 1.5 | Good | Bad |
| Comp. Example 8 | 2-c' | 1.5 | Good | Bad |

Example 9

(a) Production of thermal transfer recording sheet

A coating solution composed of 60 parts by weight of a methyl methacrylate/butyl methacrylate/2-ethyl-1-hexyl methacrylate copolymer (methyl methacrylate:butyl methyacrylate:2-ethyl-1-hexyl methacrylate=65:27:8 (by weight)), 20 parts by weight of an acrylic resin (Dianal BR-108, produced by Mitsubishi Rayon Co., Ltd., a methyl methacrylate/butyl methacrylate copolymer, Tg: 90° C.), 20 parts by weight of a polyester (Diakron ER-1001, produced by Mitsubishi Rayon Co., Ltd., Tg: 62.4° C.), 5 parts by weight of an amino-modified silicone oil (KF-857, amino equivalent: 830, viscosity: 70 cst (at 25° C.), produced by Shin-Etsu Chemical Industries Co., Ltd.), 5 parts by weight of a carboxy-modified silicone oil (X-22-162C, carboxyl equivalent: 2330, viscosity: 207 cst (at 25° C.), produced by Shin-Etsu Chemical Industries Co., Ltd.), 200 parts by weight of toluene and 200 parts by weight of methyl ethyl ketone was prepared.

The content of the methacrylic ester (2-ethyl-2-hexyl methacrylate) of the alcohol having a carbon number of 6–10 in the whole high-molecular weight material (acrylate copolymer, LR-108 and ER-1001) in the said coating solution was 4.8 wt % (8 wt %×60 parts by weight+(60+20+20) parts by weight).

This coating solution was applied on a biaxially stretched polyethylene terephthalate film (6 μm in thickness) to a wet coating thickness of about 10 μm and dried at a temperature of 100° C. for one minute to form a heat-resistant lubricating layer. On the surface opposite of the base film to the heat-resistant lubricating layer of said film was applied an ink composed of 5 parts by weight of a subliming dye (C.I. Disperse Red 60), 10 parts by weight of phenoxy resin, 90 parts by weight of methyl ethyl ketone and 10 parts by weight of isopropanol, and the obtained ink coating film was dried to form a colorant layer having about 1 μm in thickness, thus making a thermal transfer recording sheet.

(b) Manufacture of image receiving material

A solution composed of 10 parts of a saturated polyester (TR-220), 0.5 parts of an amino-modified silicone oil (KF393), 15 parts of methyl ethyl ketone and 15 parts of xylene was coated on a synthetic paper (Yupo EPG150) by a wire bar, and the obtained coating film was dried (a dry coating thickness of about 5 μm) and then heat-treated in an oven at a temperature of 100° C. for 30 minutes to make an image receiving material.

(c) Thermal transfer recording test

The resin-applied side of the image receiving material made as described in (b) above was placed on the colorant layer side of the thermal transfer recording sheet produced in the manner described in (a) above, and transfer recording was carried out on the heat-resistant lubricating layer of the said recording sheet with a partial Grace-type line thermal head having a heat-generating resistor density of 8 dot/mm, either under printing pressure of 2 kg by applying no printing energy or by applying a power of 0.4 W/dot at a density of 8 line/mm for an area of 200 mm. The rotational torque of the platen for both modes of transfer recording was measured by a load torque tester (MDT2-AMPF, manufactured by Shinmei Electric Co., Ltd.), and the coefficient of friction was calculated from the measurements. The results are shown in Table 7.

Example 10

The procedure of Example 9 was conducted except that 30 parts by weight, instead of 60 parts by weight, of methyl methacrylate/butyl methacrylate/2-ethyl-1-hexyl methacrylate copolymer (methyl methacrylate:butyl methacrylate:2-ethyl-1-hexyl methacrylate=65:27:8) and 50 parts by weight, instead of 20 parts by weight, of BR-10 were used. The results are shown in Table 7.

The content of the methacrylic ester (2-ethyl-2-hexyl methacrylate) of the alcohol having a carbon number of 6–10 in the whole high-molecular weight material (acrylate copolymer, BR-108 and ER-1010) was 2.4% (8 wt %×30 parts by weight+(30+50+20) parts by weight).

Comparative Example 9

The procedure of Example 9 was conducted except that no methyl methacrylate/t-butyl/methacrylate-2-ethyl-1-hexyl methacrylate copolymer was used and that 80 parts by weight, instead of 20 parts by weight, of BR-108 was used, and the same thermal transfer recording test as in Example 9 was conducted. The results are shown in Table 7.

Comparative Example 10

The procedure of Example 9 was conducted except that a methyl methacrylate/alkyl methacrylate (Acryosteal SL, a mixture of methacrylic ester of $C_{12}$ alcohol and methacrylic ester of $C_{13}$ alcohol, produced by Mitsubishi Rayon Co., Ltd.) copolymer (methyl acrylate:alkyl methacrylate=90:10 (by weight), Tg: 75° C.) was used in place of the methyl methacrylate/butyl methacrylate/2-ethyl-1-hexyl methacrylate copolymer, and the same recording test as in Example 9 was conducted. The results are shown in Table 7.

Comparative Example 11

The procedure of Example 9 was conducted except that a methyl methacrylate/stearyl acrylate copolymer (methyl methacrylate:stearyl acrylate=90:10 (by weight), Tg: 97° C.) was used in place of the methyl methacrylate/butyl methacrylate/2-ethyl-1-hexyl methacrylate copolymer, and the same recording test as in Example 9 was conducted. The results are shown in Table 7.

Comparative Example 12

The procedure of Example 9 was conducted except that the carboxy-modified silicone (X-22-162C) was not used, and the same recording test as in Example 9 was conducted. The results are shown in Table 7.

Comparative Example 13

The procedure of Example 9 was conducted except that the amino-modified silicone (KF-857) was not used, and the same recording test as in Example 9 was conducted. The results are shown in Table 7.

TABLE 7

| | Measurements of static coefficient of friction | | |
|---|---|---|---|
| | During no heat-supplying (A) | During heat-supplying (B) | A/B |
| Example 9 | 0.10 | 0.10 | 1.0 |
| Example 10 | 0.10 | 0.13 | 0.77 |
| Comp. Example 9 | 0.10 | 0.21 | 0.48 |
| Comp. Example 10 | 0.14 | 0.16 | 0.88 |
| Comp. Example 11 | 0.19 | 0.18 | 1.05 |
| Comp. Example 12 | 0.11 | * | — |
| Comp. Example 13 | 0.14 | * | — |

(Note)
*: Unable to measure because of too large friction due to fusion, etc.

Examples 11–14

(a) Production of thermal transfer recording sheet

A biaxially stretched polyethylene terephthalate film (5 μm in thickness) was used as base film. A coating solution of the composition shown in Table 8 was coated on one sides of the said film to a wet coating thickness of about 10 μm and then dried at a temperature of 100° C. for one minute to form a heat-resistant lubricating layer. In the Tables Tg denotes glass transition point.

On the opposite surface of the base film to the heat-resistant lubricating layer was applied an ink composed of 5 parts of a subliming dye (C.I. Solvent Blue 95), 10 parts of polysulfone resin and 35 parts of chlorobenzene, and the obtained ink coating film was dried to form a colorant layer having about 1 μm in thickness, thereby making a thermal transfer recording sheet.

(b) Manufacture of image receiving material

A solution composed 10 parts of a saturated polyester (TR-220), 0.5 parts of an amino-modified silicone (KF393), 15 parts of methyl ethyl ketone and 15 parts of xylene was coated on a synthetic paper (Yupo FPG150) by a wire bar, and the obtained coating film was dried (to a dry coating thickness of about 5 μm) and then heat-treated in an oven at a temperature of 100° C. for 30 minutes to make an image receiving material.

(c) Result of thermal recording

The resin-applied side of the above image receptor was placed on the colorant layer side of the recording sheet produced in the manner described above, and thermal recording was carried out according to the simultaneous system of the present invention and a conventional synchronous system under the following conditions, on the heat-resistant lubricating layer side of the recording sheet by using a partial Grace-type line thermal head having a heat-generating resistor density of 8 dot/mm.

(1) Synchronous (simultaneous) system of the present invention 200 mm transfer recording by feeding the sheet at a constant rate of 4 mm/sec by DC motor drive and applying power of 0.4 W/dot for 10 milliseconds in one recording period of 33 milliseconds.

(2) Conventional synchronous system 200 mm transfer recording by feeding the sheet at a density of 8 line/mm for 10 milliseconds in one recording period of 33 milliseconds by step motor drive and applying power of 0.4 W/dot for 10 milliseconds in remaining 23 milliseconds.

The results are shown as recording characteristics (running property) in Table 10.

(d) Evaluation of storage stability

The above recording sheet was wound around a 1-inch paper tube and kept under an environment of 60° C. and 60% RH for 2 weeks, and then the degree of back-side transfer of the dye from the colorant layer side of the sheet was examined. The results are shown in Table 10.

(e) Evaluation of image roughness

Heat was applied to the above recording sheet by a thermal head so as to have a half-better value with an optical density (OD) of about 1.0, and the density unevenness after monochromatic transfer recording was visually observed. The results are shown in Table 10.

Comparative Examples 14–17

Various types of sheet were produced in the same way as the above Examples 11 to 14 except for use of the coating solutions specified in Table 9. In the case of 2-c", curing by UV irradiation was conducted after coating under the same conditions as in the Examples of Japanese Patent Application Laid-Open (KOKAI) No. 5-16548, and in the case of 2-d", heat curing was conducted after coating under the same conditions as in the Examples of Japanese Patent Publication (KOKOKU) No. 4-79317. Same evaluations as in the above-described Examples were made, with the results shown in Table 10.

Each sheet was defective in running or poor in storage stability, and thus was incapable of practical use.

TABLE 8

| No. | 1-a" Components | (parts) | 1-b" Components | (parts) | 1-c" Components | (parts) | 1-d" Components | (parts) |
|---|---|---|---|---|---|---|---|---|
| Resin | Acrylic resin (Tg = 95° C.) Dianal BR-108 (Mitsubishi Rayon) | 8.25 | Vinyl chloride/ Vinyl acetate resin (Tg = 79° C.) VAGH (UCC) | 8.25 | Polyvinyl acetal resin (Tg = 110° C.) Eslec KS-1 (Sekisui Chemical) | 8.25 | Polyvinyl butyral resin (Tg = 855° C.) Eslec B-1 (Sekisui Chemical) | 8.25 |
| Lubricant | Amino-modified silicone KF-857 (Shin-Etsu Chemical) | 0.6 | Amino-modified silicone KF-857 (Shin-Etsu Chemical) | 0.6 | Amino-modified silicone KF-857 (Shin-Etsu Chemical) | 0.6 | Amino-modified silicone KF-857 (Shin-Etsu Chemical) | 0.6 |
| | Carboxy-modified silicone X-22-162C (Shin-Etsu Chemical) | 0.6 | Carboxy-modified silicone X-22-162C (Shin-Etsu Chemical) | 0.6 | Carboxy-modified silicone X-22-162C (Shin-Etsu Chemical) | 0.6 | Carboxy-modified silicone X-22-162C (Shin-Etsu Chemical) | 0.6 |
| Fine Particles | Aerozil silica R-812 (Nippon Aerosil) | 0.25 | Aerosil silica R-812 (Nippon Aerosil) | 0.25 | Aerozil silica R-812 (Nippon Aerosil) | 0.25 | Aerozil silica R-812 (Nippon Aerosil) | 0.25 |
| | Trefil E-730S (Toray Silicone) | 0.25 | Trefil E-730S (Toray Silicone) | 0.25 | Trefil E-730S (Toray Silicone) | 0.25 | Trefil E-730S (Toray Silicone) | 0.25 |
| Solvent | Toluene | 60 | Toluene | 60 | Toluene | 60 | Toluene | 60 |
| | Methyl ethyl ketone | 30 | Methyl ethyl ketone | 30 | Methyl ethyl ketone | 30 | Methyl ethyl ketone | 30 |

TABLE 9

| No. | 2-a" Components | (parts) | 2-b" Components | (parts) | 2-c" Components | (parts) | 2-d" Components | (parts) |
|---|---|---|---|---|---|---|---|---|
| Resin | Acrylic resin (Tg = 35° C.) Dianal BR-117 | 8.25 | Vinyl chloride/ vinyl acetate resin (Tg = 40° C.) | 8.25 | Epoxy acrylate resin SP-1509 (Showa Kobunshi) | 2.8 | Polyvinyl butyral resin (Tg = 85.5° C.) | 6 |

TABLE 9-continued

| No. | 2-a" Components | (parts) | 2-b" Components | (parts) | 2-c" Components | (parts) | 2-d" Components | (parts) |
|---|---|---|---|---|---|---|---|---|
| | (Mitsubishi Rayon) | | VYES (UCC) | | Dipenta-erythritol hexacrylate resin KAYARAD DPHA (Nippon Kayaku) | 1.2 | Eslec BX-1 (Sekisui Chemical) | |
| Curing agent | | | | | Darocur 1173 (Merc & Co.) | 0.2 | Diisocyanate collonate L (Nippon Polyurethane)(using an amine type catalyst) | 2.4 |
| Lubricant | Amino-modified silicone KF-857 (Shin-Etsu Chemical) | 0.6 | Amino-modified silicone KF-857 (Shin-Etsu Chemical) | 0.6 | Amino-modified silicone oil KF-393 (Shin-Etsu Industries) | 0.1 | Phosphoric ester A208S (Daiichi Kogyo Seiyaku) | 1.2 |
| | Carboxy-modified silicone X-22-162C (Shin-Etsu Chemical) | 0.6 | Carboxy-modified silicone X-22-162C (Shin-Etsu Chemical) | 0.6 | | | Na salt of phosphoric ester GAFAC RD720 (Toho Chemical) | 0.7 |
| Fine Particles | Aerozil silica R-812 (Nippon Aerosil) | 0.25 | Aerosil silica R-812 (Nippon Aerosil) | 0.25 | Trefil E-730S (Toray Silicone) | 0.4 | Calcium carbonate HAKUENKA DD (Shiraishi Calcium) | 0.5 |
| | Trefil E-730S (Toray Silicone) | 0.25 | Trefil E-730S (Toray Silicone) | 0.25 | | | | |
| Solvent | Toluene | 60 | Toluene | 60 | Ethyl acetate | 30 | Toluene | 47 |
| | Methyl ethyl ketone | 30 | Methyl ethyl ketone | 30 | Isopropyl alcohol | 15 | Methyl ethyl ketone | 47 |

TABLE 10

| No. | Solution composition | Storage stability | Image roughness | Recording characteristics (Running property) Sinultaneous System | Conventional Synobronous System |
|---|---|---|---|---|---|
| Example 11 | 1-a" | Good | Good | Good | Bad |
| Example 12 | 1-b" | Good | Good | Good | Bad |
| Example 13 | 1-c" | Good | Good | Good | Bad |
| Example 14 | 1-d" | Good | Good | Good | Bad |
| Comp. Example 14 | 2-a" | Bad | Good | Good | Bad |
| Comp. Example 15 | 2-b" | Bad | Good | Good | Bad |
| Comp. Example 16 | 2-c" | Good | Bad | Good | Good |
| Comp. Example 17 | 2-d" | Good | Bad | Good | Good |

What is claimed is:

1. A thermal transfer recording sheet comprising a base film, a colorant layer provided on one side of said base film and containing a heat-transferable dye, and a heat-resistant lubricating layer provided on the other side of said base film and containing a thermoplastic resin having a glass transition point of not less than 50° C., an amino-modified silicone oil and a carboxy-modified silicone oil.

2. A thermal transfer recording sheet according to claim 1, wherein the thermoplastic resin having a glass transition point of not less than 50° C. is acrylic-based resins, vinyl chloride-based resins, styrene/acrylonitrile copolymers, polycarbonates, polyesters or polyacetals.

3. A thermal transfer recording sheet according to claim 1, wherein the amino-modified silicone oil is a compound represented by the following formula (1), with at least part of R therein being substituted with amino group:

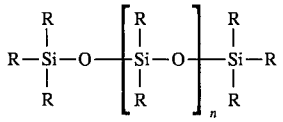

(1)

wherein R represents each a methyl group, a phenyl group or both of methyl group and phenyl group.

4. A thermal transfer recording sheet according to claim 1, wherein the carboxy-modified silicone oil is a compound represented by the formula (1), with at least part of R therein being substituted with carboxyl group.

5. A thermal transfer recording sheet according to claim 1, wherein the gram number of the amino-modified silicone oil or carboxy-modified silicone oil per mole of modifying group is not more than 5,000 g, and the viscosity thereof is 20 to 7,000 cst.

6. A thermal transfer recording sheet according to claim 1, wherein the total amount of amino-modified silicone oil and carboxy-modified silicone oil is 1 to 20 wt % based on the thermoplastic resin, and the weight ratio of the amino-modified silicone oil to the carboxy-modified silicone oil is 100; 1 to 1:100.

7. A thermal transfer recording sheet according to claim 1, wherein the heat-resistant lubricating layer further contains spherical particles and fine particles having a smaller average particle size than the spherical particles.

8. A thermal transfer recording sheet according to claim 7, wherein the average particle size of the spherical particles is 0.5 to 5 μm.

9. A thermal transfer recording sheet according to claim 7, wherein the spherical particles are made of a silicone resin or a silicone elastomer.

10. A thermal transfer recording sheet according to claim 7, wherein the fine particles are finely divided silica particles or finely divided titanium oxide particles.

11. A thermal transfer recording sheet according to claim 7, wherein the average particle size of the fine particles is not more than 1/10 of the average particle size of the spherical particles.

12. A thermal transfer recording sheet according to claim 1, wherein the amount of the spherical particles is 1 to 50 parts by weight based on 100 parts by weight of the thermoplastic resin, and the amount of the fine particles is 5 to 100 parts by weight based on 100 parts by weight of the thermoplastic resin.

13. A thermal transfer recording sheet according to claim 1, wherein the heat-resistant lubricating layer further contains a high-molecular weight compound having as its component an acrylic ester, a methacrylic ester or both of acrylic and methacrylic esters of an alkyl alcohol having 6 to 10 carbon atoms in the molecule.

14. A thermal transfer recording sheet according to claim 13, wherein the content of said ester(s) in the high-molecular weight compound is 0.5 to 100 mol %.

15. A thermal transfer recording sheet according to claim 13, wherein the weight ratio of the high-molecular weight compound to the thermoplastic resin is 1:0–20.

16. A thermal transfer recording sheet according to claim 13, wherein the weight ratio of the high-molecular weight compound (A) and thermoplastic resin (B) to the amino-modified silicone oil (C) and carboxy-modified silicone oil (D) is 1:0.02–0.3.

17. A thermal transfer recording method comprising supplying heat through a thermal head to a thermal transfer recording sheet comprising a base film, a colorant layer provided on one side of said base film and containing a heat-transferable dye, and a heat-resistant lubricating layer provided on the other side of said base film through said thermal head to transfer the heat-transferable dye in said sheet to an image receiving material from said heat-resistant lubricating layer side of said base film, wherein said heat-resistant lubricating layer contains a thermoplastic resin having a glass transition point of not less than 50° C., an amino-modified silicone oil and a carboxy-modified silicone oil, and simultaneously feeding the thermal transfer receiving sheet through said thermal head while supplying heat through said thermal head.

* * * * *